US008485798B2

(12) United States Patent
Sheth et al.

(10) Patent No.: US 8,485,798 B2
(45) Date of Patent: Jul. 16, 2013

(54) PUMP APPARATUS, SYSTEMS AND METHODS

(75) Inventors: Ketankumar K. Sheth, Tulsa, OK (US); Thurkral Mandeep, Bartlesville, OK (US); John D. Rowatt, Bartlesville, OK (US); Steven L. Anyan, Bartlesville, OK (US); Michael W. Miller, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 175 days.

(21) Appl. No.: 12/830,540

(22) Filed: Jul. 6, 2010

(65) Prior Publication Data

US 2010/0272504 A1 Oct. 28, 2010

Related U.S. Application Data

(63) Continuation of application No. 11/164,301, filed on Nov. 17, 2005, now Pat. No. 7,775,779.

(51) Int. Cl.
*F04B 35/04* (2006.01)

(52) U.S. Cl.
USPC ..... 417/423.6; 403/300; 403/359.1; 464/182

(58) Field of Classification Search
USPC ..... 417/423.6; 403/298, 300, 359.1, 403/490; 464/182
See application file for complete search history.

(56) References Cited

U.S. PATENT DOCUMENTS

| | | | | |
|---|---|---|---|---|
| 2,748,578 | A * | 6/1956 | Potts | 464/10 |
| 2,978,253 | A | 4/1961 | Weiss et al. | |
| 3,260,541 | A | 7/1966 | Sadler et al. | |
| 3,273,508 | A | 9/1966 | Lung | |
| 3,359,171 | A | 12/1967 | Hanke | |
| 3,468,169 | A | 9/1969 | Welch | |
| 4,246,689 | A | 1/1981 | Deli | |
| 4,606,671 | A | 8/1986 | Rasmussen | |
| 4,848,939 | A * | 7/1989 | Ludwig | 384/626 |
| 4,954,004 | A | 9/1990 | Faber et al. | |
| 5,688,067 | A * | 11/1997 | Straub | 403/305 |
| 6,425,735 | B1 | 7/2002 | Sheth | |
| 6,530,715 | B1 | 3/2003 | Kraft et al. | |
| 2002/0179305 | A1 * | 12/2002 | Mack et al. | 166/377 |
| 2006/0222537 | A1 | 10/2006 | Kilty | |

FOREIGN PATENT DOCUMENTS

| | | |
|---|---|---|
| DE | 20312368 | 10/2003 |
| WO | 02/099284 | 12/2002 |

* cited by examiner

*Primary Examiner* — Charles Freay
*Assistant Examiner* — Patrick Hamo
(74) *Attorney, Agent, or Firm* — Jim Patterson

(57) ABSTRACT

Pump apparatus, systems and methods of making and using same are disclosed. One inventive system includes a coupling member, a first shaft and a second shaft, the coupling member connecting the first shaft with the second shaft, the coupling member defining a first axial chamber accepting the first shaft, and a second axial chamber accepting the second shaft, the chambers separated by a coupling plate, the chambers including torsional motion transmitting elements and axial motion securing elements in the first and second axial chambers for axially securing the shafts in the coupling member. This abstract allows a searcher or other reader to quickly ascertain the subject matter of the disclosure. It will not be used to interpret or limit the scope or meaning of the claims.

17 Claims, 12 Drawing Sheets

PUMP APPARATUS, SYSTEMS AND METHODS

BACKGROUND OF THE INVENTION

1. Field of Invention

The present invention relates generally to the field of fluid transfer, and more specifically to submersible and surface pump apparatus and systems and methods of making and using same.

2. Related Art

Vertical and horizontal centrifugal pump systems are designed to operate in downthrust mode, where pressure inside the pump case by action of the pump impellers tends to exert an axial force on the pump shaft toward the suction inlet. Most pump and motor manufacturers instruct users not to operate these pumps in upthrust mode, where pressure exerted by pumped fluid against the impellers at the suction inlet may result in damaged impellers, a damaged pump shaft, and damaged pumps seals and bearings. Upthrust conditions may exist at startup, when operating at high flow rates, and/or when the specific gravity of the fluid being pumped changes. In the upthrust condition, bearings may not be cooled sufficiently due to lack of recirculation and may fail. Some pump manufacturers use a disk-type upthrust pad at the discharge/exit area of the pump to limit the upthrust movement of the shaft. Other pump manufactures have used combinations of a grooved upthrust pad in the diffuser and grooved radial bore in the diffuser to prevent the loss of lubrication to the bearing in the upthrust condition. These approaches are not always successful.

It is evident that there is a need in the art for pump apparatus and methods which more adequately address the upthrust condition problem.

SUMMARY OF THE INVENTION

In accordance with the present invention, coupling members, systems including same, and methods of making and using same are described that reduce or overcome problems in previously known apparatus and methods. Apparatus of the invention comprise a securing mechanism to limit upthrust, or limit the tendency of a pump shaft going into the upthrust condition, and therefore reduce or prevent failure. In systems of the invention one shaft, such as a pump shaft, is secured axially and rotationally to the coupling, and the coupling is in turn secured axially and rotationally to a second shaft, such as a thrust chamber shaft.

A first aspect of the invention is coupling members adapted to connect a first shaft, such as a pump shaft, with a second shaft, such as a thrust chamber shaft. The coupling members of the invention are adapted to connect a first shaft with a second shaft, the coupling member comprising means for transmitting rotational movement between the shafts and means for securing the shafts from substantial axial movement during rotation of the shafts and coupling member, the coupling member including at least one torque-limiting element. The first shaft may be a pump shaft while the second shaft may be a thrust chamber shaft, although the invention is not so limited. Any means for securing the first and second shafts to the coupling member may be used, including any combination of male/female connections, as long as the transmission of rotational motion and axial securing functions are achieved. For example, coupling member may have dual female receptacles for accepting ends of the shafts; one side of the coupling member may have a female receptacle while the other has a male portion connecting to a female portion of the other shaft, and so on. In certain embodiments, the coupling member defines a first axial chamber adapted to accept a first end of the first shaft, and a second axial chamber adapted to accept a first end of the second shaft, the axial chambers separated by a coupling plate, which in some embodiments has a through hole adapted to accept a male portion of an axial motion securing member, and in other embodiments is a solid plate. The means for transmitting rotational movement may be selected from splines, pins, bolts, rivets, clamps, rings, threads, grooves, gears, bearings, collets, or other equivalent functional elements. The coupling members may also include axial motion securing elements in the first and second axial chambers for axially securing the shafts in the coupling member.

For convenience only, the first shaft is hereinafter referred to as the pump shaft, and the second shaft is referred to as a thrust chamber shaft, however, those of skill in the art will recognize that the inventive coupling members, systems, and methods may be used when coupling any two rotating shafts.

The inventive coupling members may be used in systems of the invention, which comprise a second aspect of the invention. Systems of the invention comprise a coupling member connecting a first shaft with a second shaft, the coupling member comprising means for transmitting rotational movement between the shafts and means for securing the shafts from substantial axial movement during rotation of the shafts and coupling member, the coupling member including at least one torque-limiting element. In certain embodiments, the first end of the pump shaft, or a sub-shaft or component intermediate of the pump shaft first end is axially secured in the inventive coupling member. One way of accomplishing this is by virtue of a female aperture or receptacle extending inwardly from the pump shaft first end a certain distance and accepting a male portion of a pump shaft axial securing member, the female receptacle and the male portion of the pump shaft axial securing member being threaded in matching relationship. The pump shaft axial securing member may have a head, forming with the male portion a bolt. In these embodiments the male portion protrudes through a central through hole in a coupling plate and threadingly engages the threads in the female receptacle, while the head engages the coupling plate, thus axially securing the pump shaft to the coupling member upon tension forces, in other words, forces tending to move the pump shaft axially away from the coupling plate, such as during upthrust conditions.

Alternatively, systems of the invention include those wherein the female receptacle in the pump shaft first end may comprise one or more grooves, such as J grooves, while the male portion of the pump shaft adjusting member includes one or more radially extending pins or other protuberances, the pins sliding into matching respective grooves and engaging a portion of the groove to axially secure the pump shaft. Other shaped grooves may of course be used, as long as the securing function is achieved. In certain system embodiments the pump shaft may be axially secured to the coupling member by one or more pins inserted through matching transverse passages through walls of the coupling member which define the first chamber and through a corresponding transverse passage in the pump shaft. The pin or pins may be tapered, threaded their whole or a portion of their length, or held by cotter pins. The pins may comprise any shape and material sufficient to provide the axial securing function, that is, of retaining the axial position of the pump shaft and coupling member so that the pump and motor thrust bearings are not damaged by upthrust or other conditions. Alternatively, to avoid forming a passage through the pump shaft, the pump shaft may be modified on its outer surface proximate the first chamber inner wall to be threaded or accept a threaded collar which also has threads on its outer surface and mating with threads on the inner wall of the first chamber. A two-piece ring, a snap ring, or combination thereof, or other axial securing retainer, as described further herein, may be employed. Alternative embodiments include those wherein the pump shaft first end comprises a female receptacle, while the coupling member comprises a male member. Any of the mentioned securing means may be used in these embodiments.

In certain system embodiments the pump shaft axial securing member is adjustable, such as when the male portion is threaded and meshes with a threaded receptacle in the pump shaft or intermediate component, or when the pump shaft end is threaded or a threaded collar is used. This has certain advantages as will be discussed herein. In addition, one or more pump shaft shims may be positioned between the coupling plate and the first end of the pump shaft, the male portion of the pump shaft axial securing member passing through the shims and through the coupling plate. The pump shaft shims, if used, may comprise a material that is the same as or different from the coupling member material and the pump shaft. In certain embodiments the pump shaft, pump shaft shims, and coupling member are all of the same material. The pump shaft axial securing member head may include surfaces allowing the head to be turned by a tool, such as a wrench, screw driver or other tool. The pump shaft axial securing member head may or may not be the same material as the male portion.

Systems of the invention include those wherein the thrust chamber shaft is axially secured in the second chamber. In certain embodiments the thrust chamber shaft is axially secured to the coupling member by a two-piece ring and snap ring. Alternatively, one or more pins may be inserted through matching transverse passages through walls of the coupling member which define the second chamber and through a passage in the thrust chamber shaft. The pin or pins may be tapered, threaded, or held by cotter pins. The pins may be comprised of any shape and material sufficient to provide the axial securing function, that is, of axially securing the relative position of the thrust chamber shaft and coupling member so that the pump and motor thrust bearings are not damaged by upthrust or other conditions. Alternatively, to avoid forming a passage through the thrust chamber shaft, the thrust chamber shaft may be modified on its outer surface proximate the second chamber inner wall to be threaded or accept a threaded collar which also has threads on its outer surface and mating with threads on the inner wall of the second chamber. Alternative embodiments include those wherein the thrust chamber shaft first end comprises a female receptacle, while the coupling member comprises a male member. Any of the mentioned securing means may be used in these embodiments.

In embodiments employing a coupling plate, the coupling plate may be positioned anywhere internally of the coupling member as long as it separates the two chambers and serves the pump shaft axially securing function in conjunction with the pump shaft axial securing member. The coupling plate may be integral to the coupling member body or a separate piece inserted into the coupling member body. Further, the coupling plate is only required when using a bolt to secure the coupling member to one of the shafts. Apparatus and systems of the invention include those wherein the coupling member is cylindrical in shape, as are the first and second axial chambers. However, neither the axial chambers nor the portions of the shafts which fit therein are required to be cylindrical in shape. In fact, square shafts, hex shafts or any other of a number of configurations could be employed for engaging the chambers or shafts together. The coupling member and coupling plate (if present) may be all one and the same material, but this is not required. Combinations of different materials may be used as desired. The coupling plate may have two substantially parallel surfaces substantially perpendicular to the longitudinal axis of the pump shaft and thrust chamber shaft. In these embodiments the pump shaft axial securing member interacts with the coupling plate by way of a head that abuts against a surface of the coupling plate that faces the thrust chamber shaft. In other embodiments, the side of the coupling plate facing the thrust chamber shaft may have a recessed area that accepts the head of the pump shaft axial securing member so that it abuts the recessed area, allowing the first end of the thrust chamber shaft to be positioned substantially flush against the coupling plate. In certain embodiments the coupling plate is positioned approximately midway between the ends of the coupling member. Apparatus and systems of the invention include those wherein the first and second axial chambers of the coupling member have equal diameters, apparatus and systems wherein the chambers have different diameters, and apparatus and systems wherein one or both axial chambers have truncated conical shape.

Apparatus and systems of the invention include a torque-limiting feature functioning to physically break the coupling member upon exposure to excessive torque conditions. One such feature is a portion of the coupling member having a reduced thickness cross section, as described more fully herein. The reduced thickness cross section or sections may be positioned anywhere, but in certain embodiments it may be advantageous to place one reduced thickness portion approximately at the axial midpoint of the coupling member, or between the coupling plate (if present) and one of the ends of the coupling member, either on the thrust shaft side or the pump shaft side of the coupling member. Two or more reduced thickness portions may be envisioned in certain other embodiments. The reduce thickness cross sections may be annular grooves or depressions of any shape. Alternatively, or in conjunction with reduced thickness cross sections, apparatus and systems of the invention may include one or more radially and/or longitudinally extending shear pins. Another alternative is the use of spring-load mechanisms, such as spring-load ball and groove features.

Another aspect of the invention are methods of making a locked pair of shafts, one method of the invention comprising:

(a) measuring axial shaft movement of first and second shafts during operation using a standard coupling;
(b) selecting a coupling member to limit the axial shaft movement; and
(c) installing the coupling member to limit the axial shaft movement.

Methods of the invention include those wherein the selecting a coupling member to limit shaft movement includes calculating the width and/or number of shaft shims required to limit the axial shaft movement, and installing one or more shaft shims in the coupling by bolting or other means. In one embodiment, the first shaft is a pump shaft that is axially secured using a bolt and optional shaft shims, while the second shaft is a thrust chamber shaft that is secured axially to the coupling using one or more pins, bolts, or other means. In horizontal and other pumping systems, the pin (or bolt or screw) may be inserted through the intake of the pump.

Yet another aspect of the invention are methods of pumping fluids, one method comprising:

(a) determining a pumping requirement for transferring a fluid;
(b) selecting a pump having a pump shaft, and a driver having a driver shaft;

(c) coupling the pump shaft and driver shaft axially using a coupling member of the invention; and (d) pumping the fluid using the pump to meet the pumping requirement.

Apparatus and systems of the invention may be used downhole pumping systems, in submersible pump systems, and in horizontal pumping systems, and may be used between any two shafts in such systems, such as shafts between a driver and a pump, between two pump sections, between a pump and an auxiliary device such as an auger or other fluid transmission device. In pumping systems including motors, especially downhole pumping systems, the systems may include a motor protector, which may or may not be integral with the motor, and may include integral instrumentation adapted to measure one or more downhole parameters. Pump systems employing apparatus and systems of the invention may be adapted to produce a dynamic head up to 7,500 feet or more. The driver shaft may be one and the same as the pump shaft in certain embodiments, and in certain other embodiments the pump shaft may be mechanically coupled to and driven by the driver shaft. In other embodiments, the driver shaft and the pump shaft may be distinct and not be coupled mechanically, such as in magnetic couplings wherein the driver shaft drives a magnetic coupling comprising magnets on the driver shaft which interact with magnets in a protector, in which case the protector shaft mechanically connects to and drives the pump shaft.

Apparatus and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1:
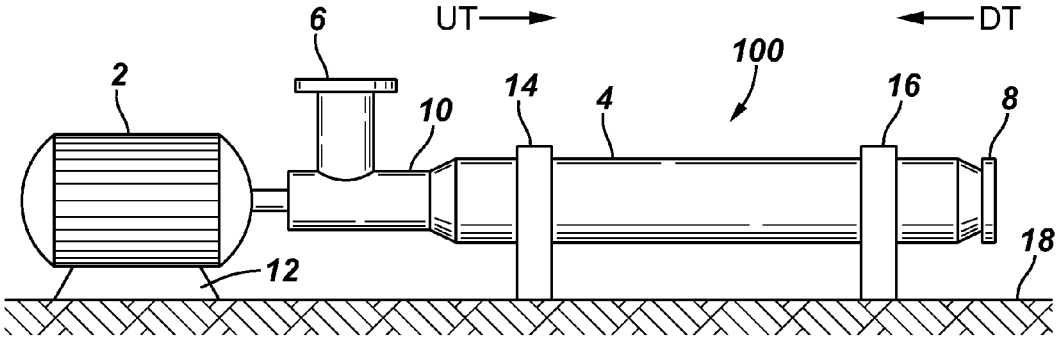
FIG. 1 (Prior Art)
FIGS. 1-3 illustrate schematically in side-elevation, partial cross-sectional views of a prior art horizontal pumping system, and certain problems therewith.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes coupling members, systems incorporating same, and methods of making and using same for pumping fluids, for example, to and from wellbores, although the invention is applicable to pumps designed for any intended use, including, but not limited to, so-called surface fluid transfer operations. A "wellbore" may be any type of well, including, but not limited to, a producing well, a non-producing well, an experimental well, and exploratory well, and the like. Wellbores may be vertical, horizontal, some angle between vertical and horizontal, and combinations thereof, for example a vertical well with a non-vertical component. As discussed, vertical and horizontal centrifugal pump systems are designed to operate in downthrust mode, where pressure inside the pump case by action of the pump impellers tends to exert an axial force on the pump shaft toward the suction inlet. Most pump and motor manufacturers instruct users not to operate these pumps in upthrust mode, where pressure exerted by pumped fluid against the impellers at the suction inlet may result in damaged impellers, damage the pump shaft, and damaged pumps seals and bearings. Upthrust conditions may exist at startup, when operating at high flow rates, and/or when the specific gravity of the fluid being pumped changes. In the upthrust condition, bearings may not be cooled sufficiently due to lack of recirculation and may fail. Previous approaches to solving these problems are not always successful.

Given that there is considerable investment in existing equipment, it would be an advance in the art if upthrust conditions and their consequences could be avoided or reduced, and further if a torque-limiting feature could be included, so that more expensive components, such as shafts, do not fail before less expensive components, such as couplings. This invention offers methods and apparatus for these purposes. A torque-limiting element is placed in the coupling members of the invention for the purpose of having the coupling "fail" at a specified torque value generally less than the value needed to "fail" either of the shafts. "Failure", as used herein, means limiting the ability of the coupling to transmit torque between the two shafts. This can be accomplished in any number of ways including appropriate choice of a coupling material(s), employing the use of one or more grooves on the OD or ID of the coupling having a variable length and depth so as to limit the cross sectional area and thus the strength of the coupling to a predetermined value. The depth of the grooves may be equal to zero depending on the design and/or choice of material. Use of one or more radial or longitudinal "shear" pins may provide the torque-limiting feature. Another means for torque limiting employs the use of a press fit member designed to slip under a given torsional load. Spring loaded mechanisms and cam loaded mechanisms may be used. Any combination of these means may be employed in a given situation.

Figure 2:
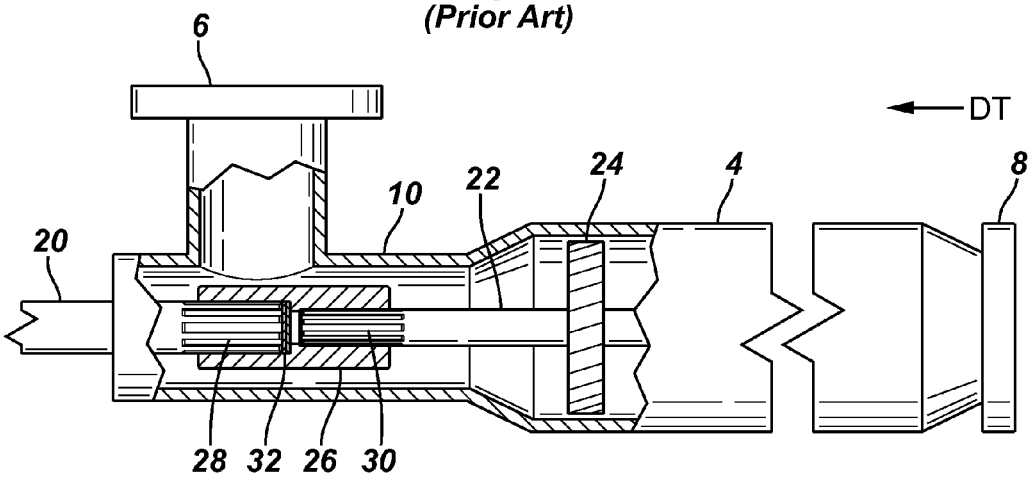
FIG. 2 (Prior Art)
Figure 3:
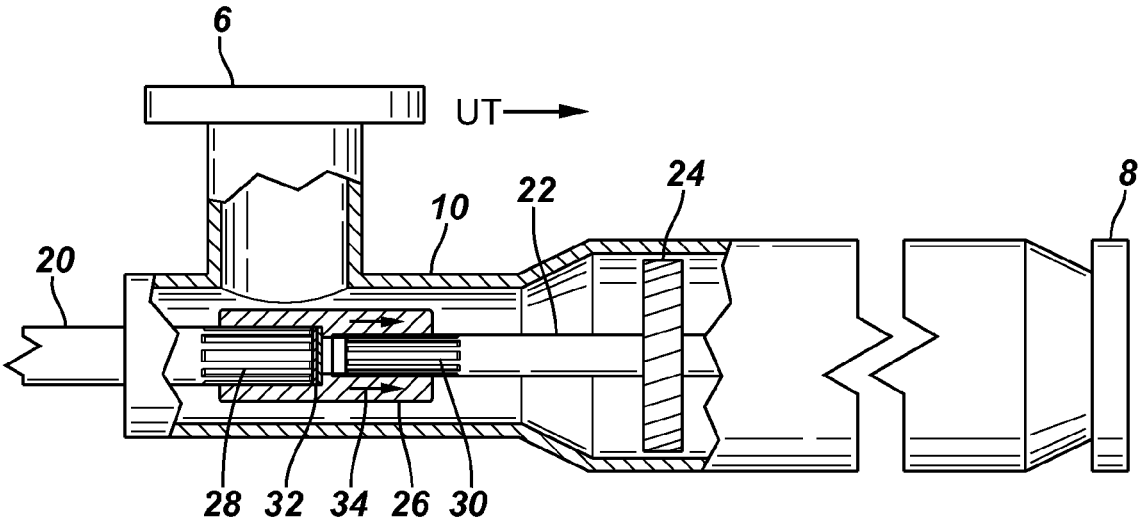
FIG. 3 (Prior Art)

FIGS. 1-3 illustrate schematic side-elevation, partial cross-sectional views of a prior art horizontal pumping system 100, useful for illustrating certain problems therewith. FIG. 1 illustrates a motor 2, horizontal pump 4 having a pump inlet 6 and a pump outlet 8, and a thrust chamber 10. Motor 2 is supported on a surface 18 by a motor support 12, and pump 4 is supported by pump supports 14 and 16. Surface 18 may be earthen, concrete, metal, or virtually any structural support member. Thrust chamber 10 has thrust bearings (not illustrated) for carrying the downthrust, indicated by arrow DT in FIGS. 1 and 2 produced by pump impellers 24. As more clearly illustrated in FIGS. 2 and 3, thrust chamber 10 connects a thrust chamber shaft 20 to a pump shaft 22 through a coupling 26 to transmit torque and rotation speed using splines 28 and 30. Shaft shims 32 are used for preventing the downward movement of the shaft so that all the down thrust produced by pumping action is transferred to the thrust bearings in the thrust chamber. Pump shaft 22 is free to move horizontally to the right in FIGS. 1-3 (or in the axial direction) allowing the stages to go in the upthrust, indicated by large arrow UT and small arrows 34 (FIG. 3).

Figure 4:
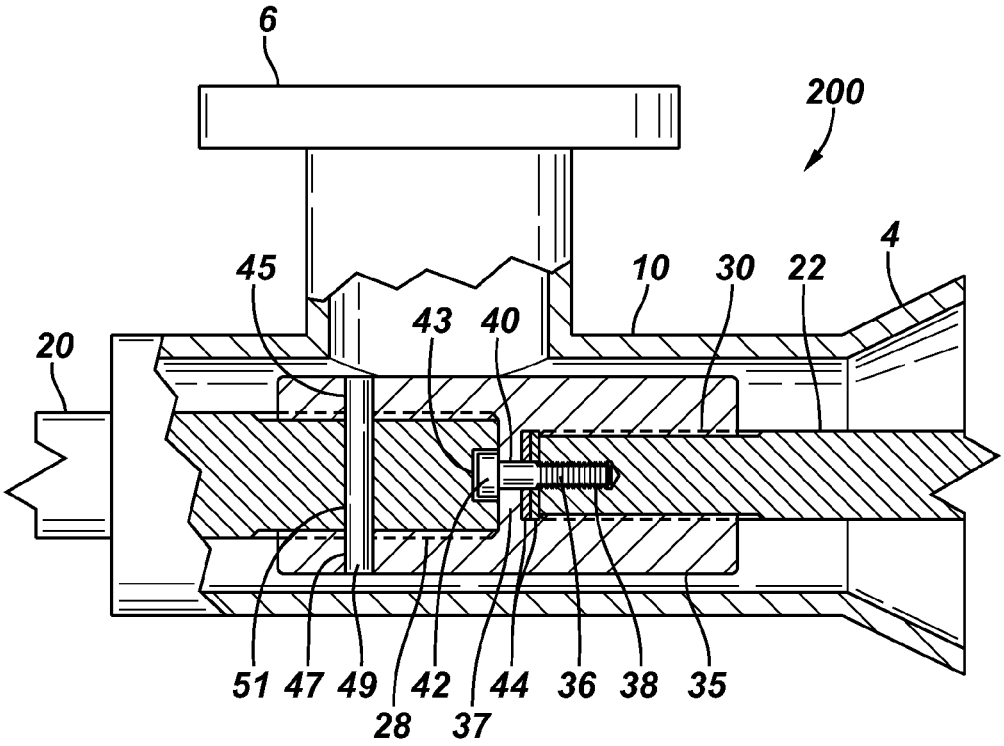
FIGS. 4-19 illustrate schematically in side elevation, partial cross-sectional views, of non-limiting embodiments of apparatus, systems, and methods of the invention.

FIGS. 4-19 illustrate schematic side-elevation, partial cross-sectional views, not necessarily to scale, of apparatus, systems, and methods of the invention only as examples, but the invention is not so limited, and are presented only for explaining some of the inventive concepts. FIG. 4 illustrates system embodiment 200 of the invention. Coupling member 35 has a first axial chamber in which a first end of pump shaft 22 is fitted with spline connections 30, and a second axial chamber into which thrust chamber shaft 20 is fitted with spline connections 28, as in previously known coupling members. However, in addition coupling member 35 has a threaded female aperture 38 extending from the end of the pump shaft inwardly a certain distance, determined by the particular tension loads expected, the materials of construction, and the like. Coupling member 35 includes in embodiment 200 a coupling plate 37 having a central through hole 40. Threaded male member 36 threadingly fits with mating threads of threaded female aperture 38. Male member 36 includes a head 42 which engages a transverse surface of coupling plate 37 inside of a recessed portion 43 of thrust shaft 20. Coupling member 35 also includes in embodiment 200 a pair of transverse through holes 45 and 47 in the wall forming the second axial chamber of coupling member 35 through which a pin 49 is tightly fitted. A similar size through hole 51 in thrust chamber shaft 20 at a matching location accepts pin 49. The arrangement of through holes 45, 47, and 51 with pin 49 serves the functions of transferring torque from thrust chamber 20 to coupling member 35 and axial tension forces. A torque-limiting feature 46 may be included, in this embodiment a groove or thin region of the wall of coupling member 35. Torque-limit feature 46, if present, functions as a failure mechanism, so that coupling member 35 may fail, rather than more expensive components, such as shafts 20, 22.

In use, pump shaft 22 movement in upthrust and downthrust conditions may be measured. Shaft shims 44 having a central through hole through which shaft 36 threadedly fits may be employed as desired. Based on the measured or observed axial movement of pump shaft 22, the length (or number) of shaft shims 44 required is calculated so that pump shaft 22 has limited movement. During installation, the required number of shaft shims 44 and pump shaft 22 are bolted to coupling member 35 with bolt 26, 42. The pump is then installed, for example in a horizontal skid. Pump shaft 22 is rotated so that the radial hole 45 in coupling member 35 and though hole 51 in thrust chamber shaft 20 match. Pin 49, which may also be a bolt, or screw, is used to secure coupling member 35 with thrust chamber shaft 20. The securing device may be installed through pump intake 6.

In certain embodiments of the invention, a variety of seals, filters, absorbent assemblies and other protection elements may be used to protect motors and other components, particularly if the apparatus and systems of the invention are to used in downhole applications. These components are not illustrated for clarity, but may include, for example, one or more thrust bearings disposed about shafts 20 and 22 to accommodate and support the thrust load from pump 4. A plurality of shaft seals may also disposed about shaft 20 between pump 4 and motor 2 to isolate a motor fluid in motor 2 from external fluids, such as well fluids and particulates. Shaft seals also may include stationary and rotational components, which may be disposed about the shafts in a variety of configurations. Systems of the invention also may include a plurality of moisture absorbent assemblies disposed throughout housings between a pumps and a motor. These moisture absorbent assemblies absorb and isolate undesirable fluids (for example, water, $H_2S$, and the like) that have entered or may enter housing through shaft seals or though other locations. For example, moisture absorbent assemblies may be disposed about shaft 20 at a location between pump 4 and motor 2. In addition, the actual protector section above the motor may include a hard bearing head with shedder.

Figure 5:
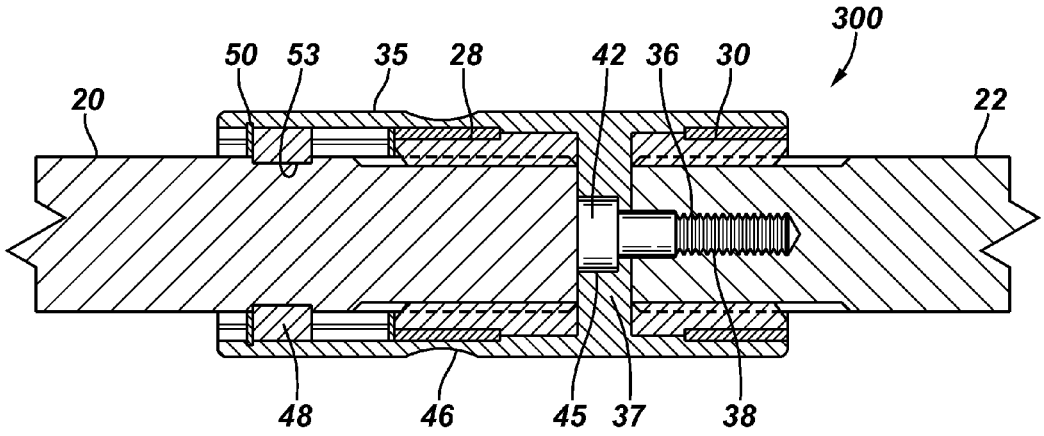

FIG. 5 illustrates another apparatus and system embodiment 300 of the invention. Coupling member 35 is similar to embodiment 200 depicted in FIG. 4, with slight differences. Pump shaft 22 is once again held in coupling member 35 via a bolt 36, 42, however in embodiment 300 bolt head 42 is set in a recessed area 45 of coupling plate 37. This allows thrust chamber shaft 20 to be flush at its end up against coupling plate 37. Another difference is that thrust chamber shaft 20 is secured axially by use of a two piece ring 48 and a snap ring 50. Two piece ring 48 is held by a groove 53 in thrust chamber shaft 20.

Figure 6:
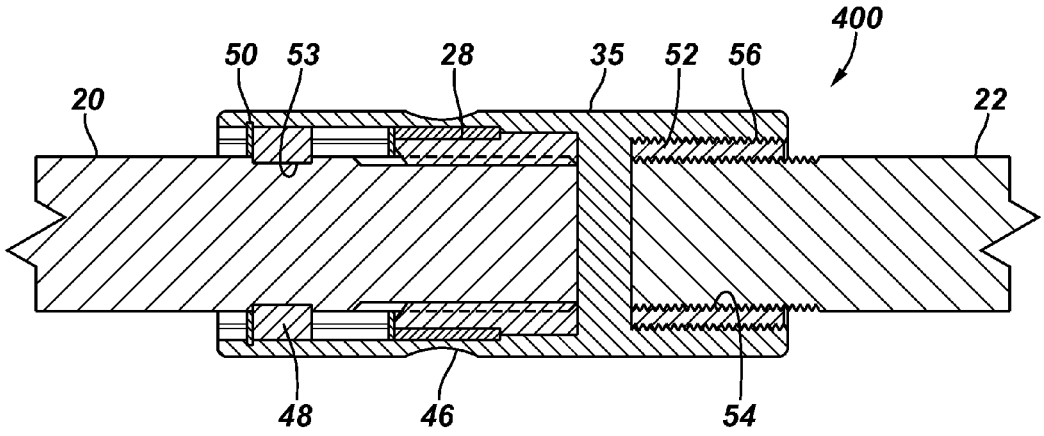

Another apparatus and system embodiment 400 is illustrated schematically in FIG. 6. Comparing to embodiment 300 of FIG. 5, note that embodiment 400 does not include a threaded bolt to axially secure pump shaft 22 to coupling member 35, but rather has a threaded collar 52, having internal threads 54 mating with similar threads on pump shaft 22, and external threads 56 matching corresponding threads on the inside wall of the first axial chamber of coupling member 35.

Figure 7:
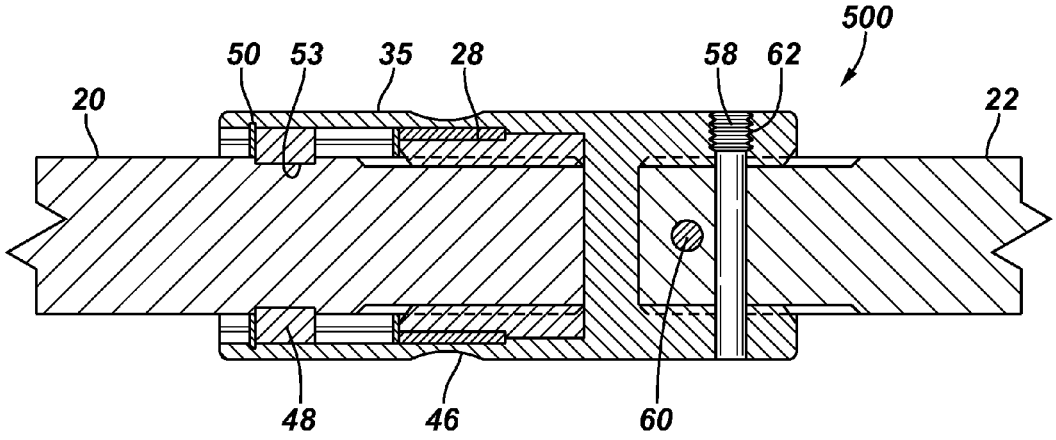

FIG. 7 illustrates apparatus and system embodiment 500 of the invention. The coupling of thrust chamber shaft 20 to coupling member 35 in embodiment 500 is exactly the same as in embodiments 300 and 400, however the coupling of pump shaft 20 to coupling member 35 makes use of two pins, bolts, or screws 58 and 60, which extend through the wall of coupling member 35 an pump shaft 20 in through holes. One pin or more than two pins may be employed as needed, depending on the particular torque requirements materials of construction, environmental conditions, and degree of safety margin desired or required by local laws, and the like.

Figure 8:
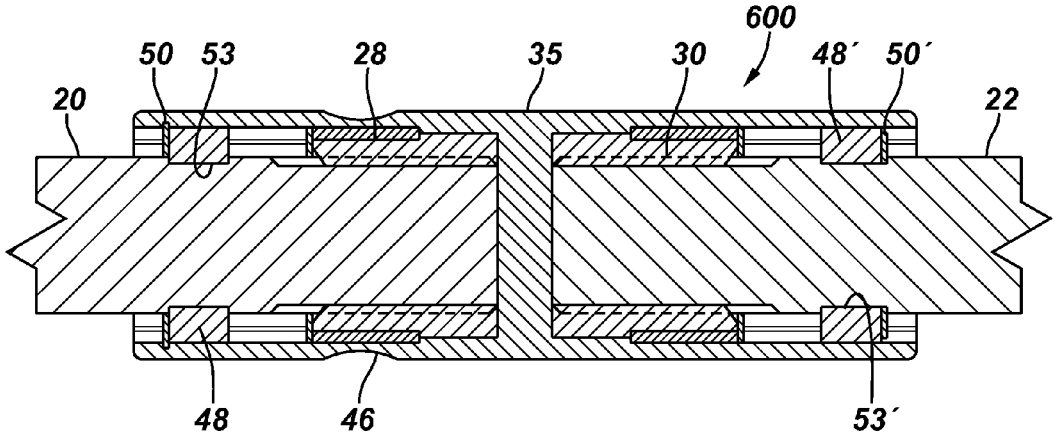

FIG. 8 illustrates yet another apparatus and system embodiment 600, wherein both the pump shaft 22 and thrust chamber shaft 20 are axially secured using two piece rings and snap rings. Thrust chamber shaft 20 is secured axially by use of two piece ring 48 and snap ring 50. Two piece ring 48 is held by a groove 53 in thrust chamber shaft 20. In like manner pump shaft 22 is secured axially by use of a two piece ring 48' and a snap ring 50'. Two piece ring 48' is held in a groove 53' in thrust chamber shaft 20.

Figure 9:
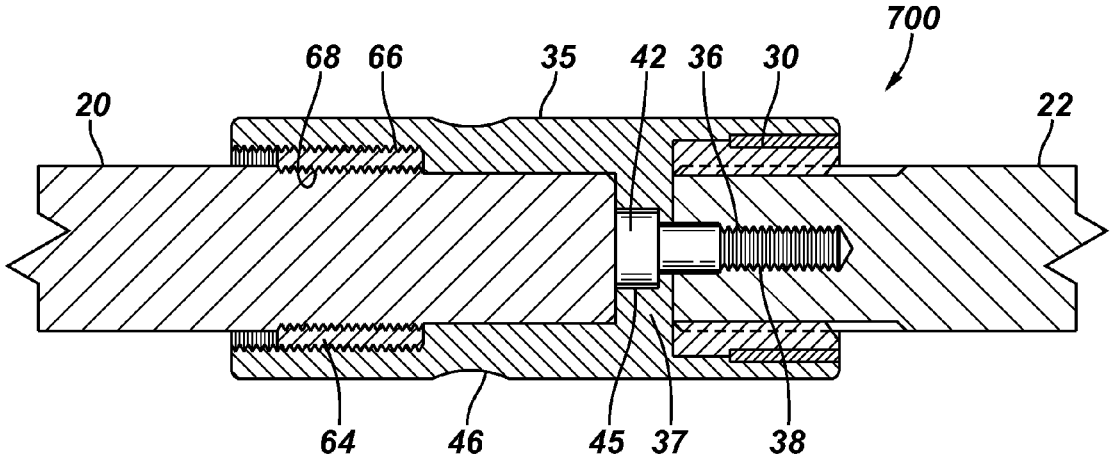
Figure 10:
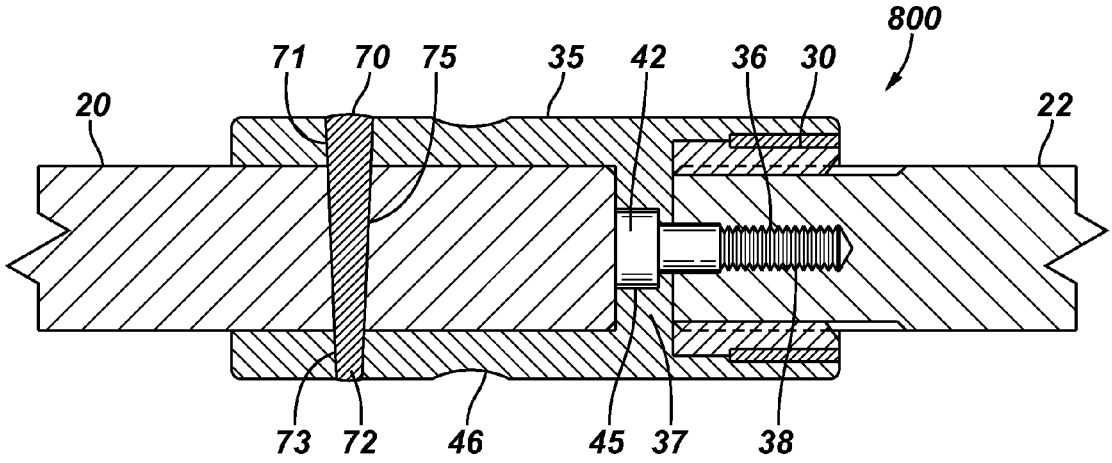

FIGS. 9 and 10 illustrate apparatus and system embodiments 700 and 800, respectively, wherein each embodiment uses the same axial securing features for pump shaft 22 as embodiment 300 of FIG. 5. In embodiment 700 of FIG. 9, thrust chamber shaft 20 is axially secured to coupling member 35 using a threaded collar 64 having internal threads 68 matching corresponding threads in thrust chamber shaft 20, and external threads 66 matching corresponding threads in coupling member 35. In embodiment 800 of FIG. 10, thrust chamber shaft 20 is axially secured in coupling member 35 using a tapered pin 70, having a smaller diameter end 72. Pin 70 is tightly fit inside through holes 71 and 73 in coupling member 35 wall, and through hole 75 in thrust chamber shaft 20. More than one pin 70 may be employed, with corresponding through holes.

Figure 11:
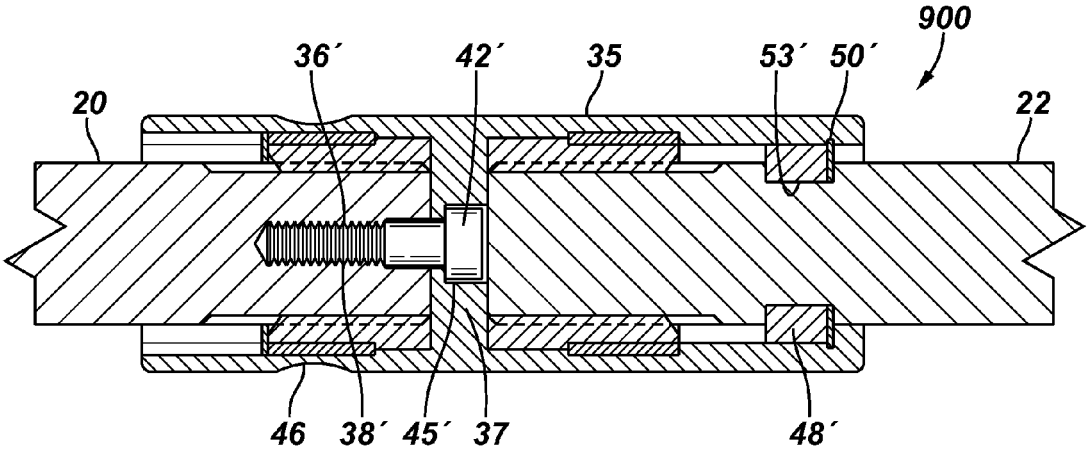

FIG. 11 illustrates another apparatus and system embodiment 900 of the invention, which may be explained as a minor image of embodiment 300 of FIG. 5. Thrust chamber shaft 20 is axially secured in coupling member 35 via a bolt 36', 42', and bolt head 42' is set in a recessed area 45' of coupling plate 37. This allows pump shaft 20 to be flush at its end up against coupling plate 37. Pump shaft 22 is secured axially by use of a two piece ring 48' and a snap ring 50'. Two piece ring 48' is held in a groove 53' in pump shaft 20.

Figure 12:
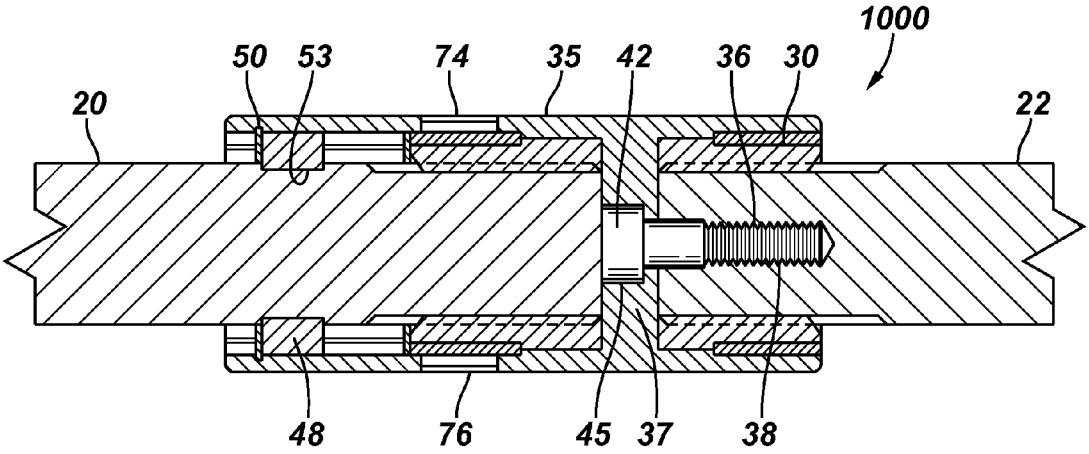
Figure 13A:
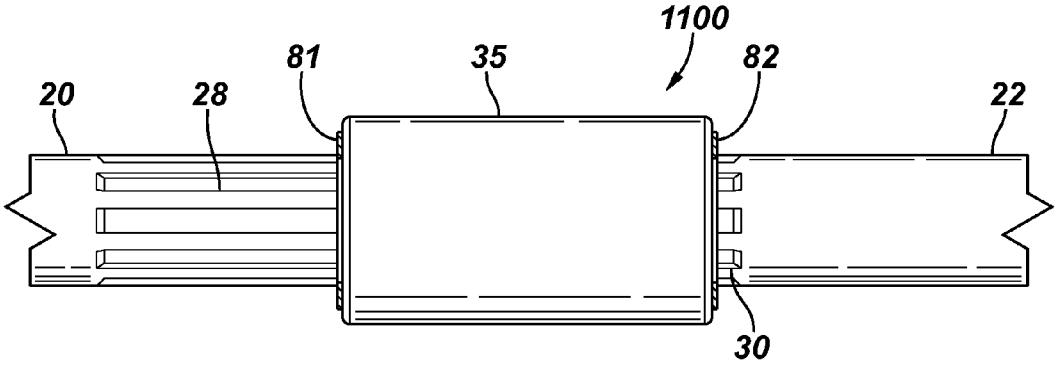
Figure 13B:
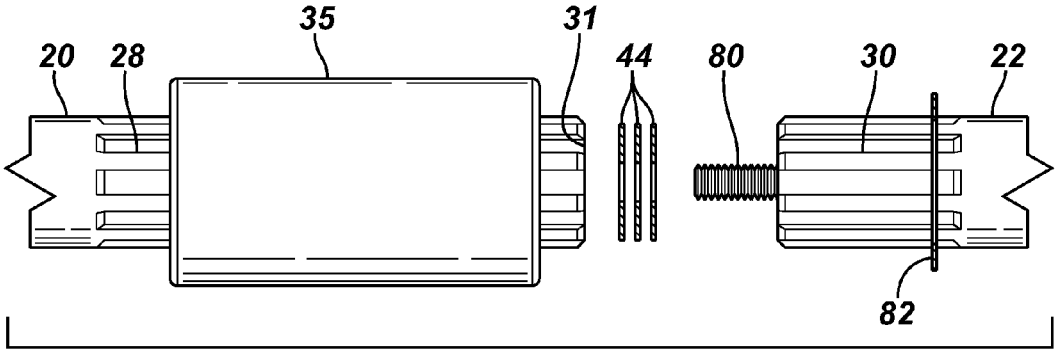
Figure 13C:
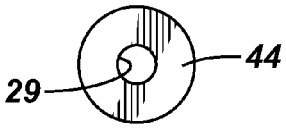
Figure 13D:
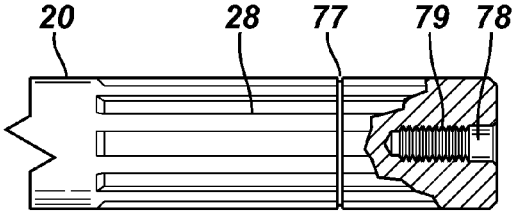
Figure 13E:
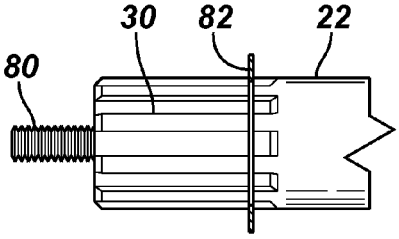

FIG. 12 illustrates another apparatus and system embodiment 1000 of the invention, identical in all aspects to embodiment 300 of FIG. 5 except for the torque-limit feature. Rather than a groove or thinned wall region 46 as in embodiment 300 of FIG. 5, embodiment 1000 of FIG. 12 includes a pair of longitudinal shear pins 74 and 76 (one pin or more than two pins may be used). Other torque-limit features, such as radially placed shear pins, radially or longitudinally placed spring-loaded mechanisms, and the like, may be used, and are considered viable options for use in apparatus, systems and methods of the invention.

FIGS. 13-19 illustrate yet other embodiments of the invention. FIG. 13A illustrates the assembled apparatus embodiment 1100, and FIG. 13B illustrates a partially exploded view. Embodiment 1100 includes a thrust chamber shaft 20 and pump shaft 22 secured in a coupling member 35. Splines 28 and 30 are used in spline connections in embodiment 1100 to provide torque transmission. Splines 28 in this embodiment are extended at 31 (FIG. 13B) so that they are longer than coupling member 35. External snap rings 81 and 82 are employed for axially securing the shafts. Groove 77 is provided in shaft 20 (FIG. 13D) for external snap ring 81, while a similar groove is provided in shaft 22 for external snap ring 82. FIG. 13B also depicts shims 44, which are optional. Shims 44 have a central through hole 29 (FIG. 13C) so that if used they will accept a threaded bolt 80, which is installed in mating threads 79 in shaft 20. An unthreaded lead-in 78 is provided to promote assembly of this embodiment. A torque-limit feature may be provided by any of the means discussed herein; in embodiment 1100, this feature would be provided by the materials of construction of coupling member 35.

Figure 14A:
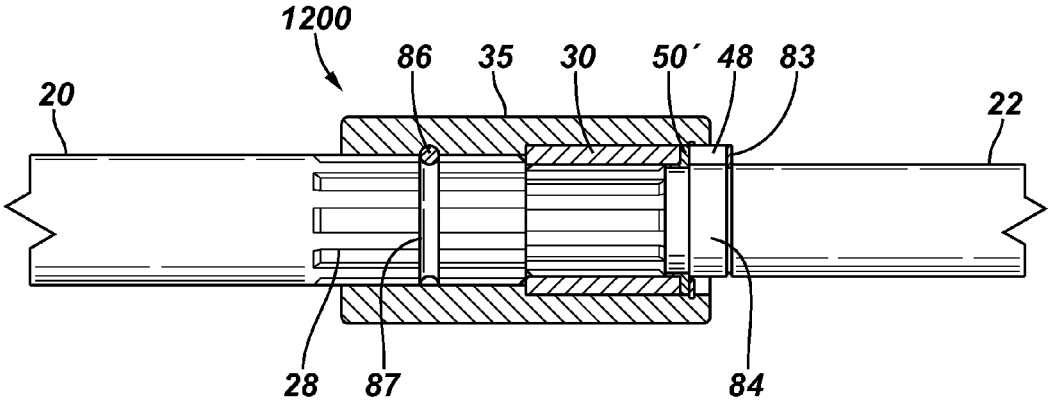
Figure 14B:
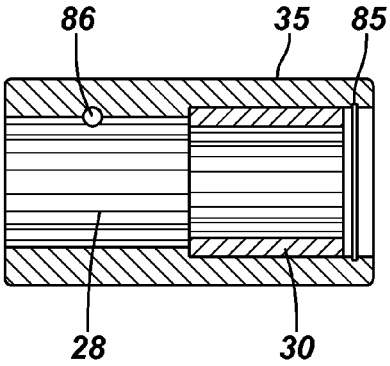
Figure 14C:
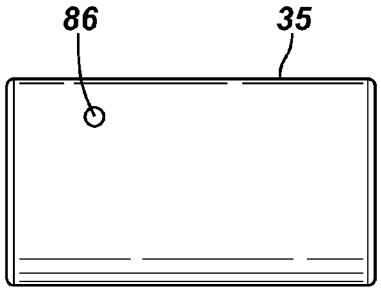
Figure 14D:
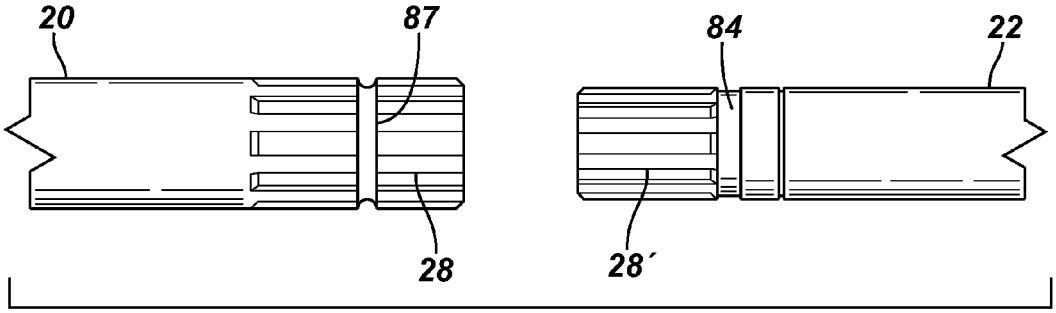

FIGS. 14A-14D illustrate another embodiment 1200 of the invention. FIG. 14A illustrates the assembled apparatus embodiment 1200, and FIG. 14D illustrates a partially exploded view without the coupling member. In embodiment 1200, spline connections 28, 28', and 30 are once again employed for torque transmission. Securing shaft 20 axially is accomplished by way of a pin (not illustrated) fitting in a through hole 86 in coupling member 35 (FIGS. 14B and 14C), and a mating cut out 87 in shaft 20. Note that cut out 87 is not a through hole in shaft 20; this may provide more strength for shaft 20. Axially securing shaft 22 is accomplished by use of an internal snap ring 50', an external snap ring 83, and two piece ring 48, the latter fitting in a channel in shaft 22 (FIG. 14D). Internal snap ring 50' fits in a groove 85 in coupling member 35 (FIG. 14B). A torque-limit feature may be provided by any of the means discussed herein; in embodiment 1200, this feature could be provided by the materials of construction of coupling member 35, as well as the through hole 86.

Figure 15A:
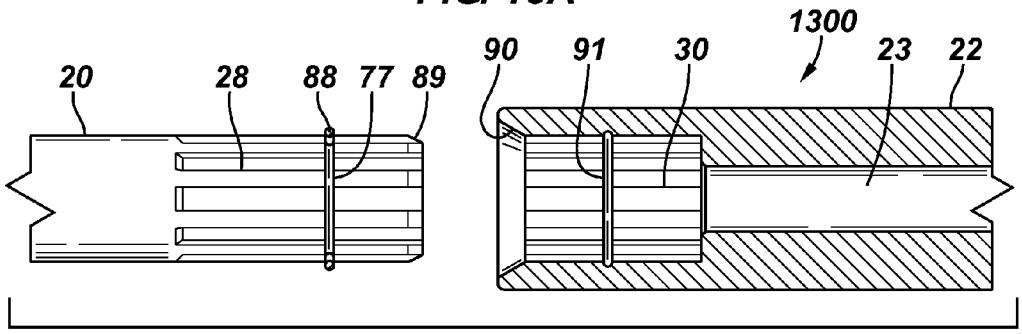
Figure 15B:
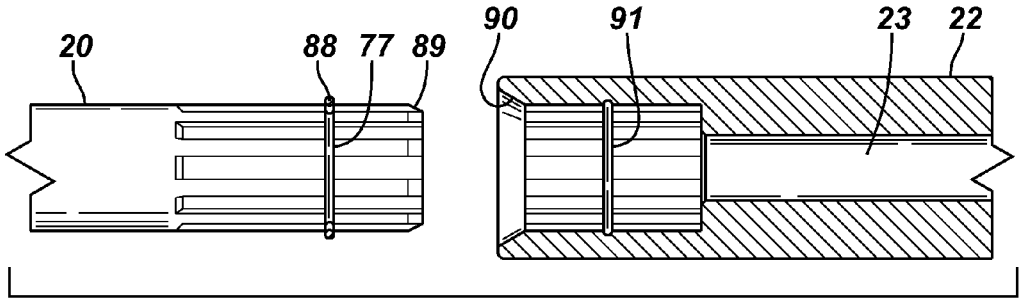
Figure 15C:
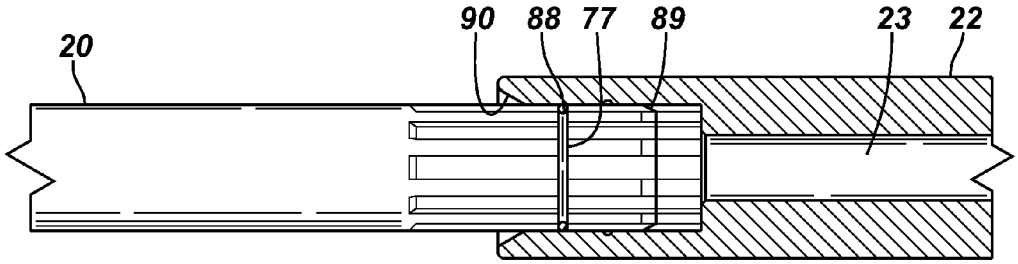
Figure 15D:
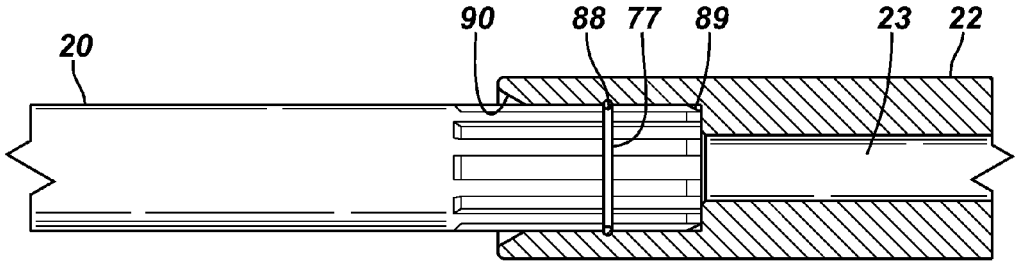

FIGS. 15A-15D illustrate another embodiment 1300 of the invention. Spline connections 28, 30 are employed for torque transmission. Embodiment 35 does not include a separate coupling member 35. Rather, coupling of shafts 20 and 22 is through a male/female connection. FIG. 15A is an exploded view of embodiment 1300, illustrating an external chamfered end 89 of shaft 20 fitting into an internal chamfered end 90 of shaft 22. A groove 77 in shaft 20 is adapted to hold a wire snap ring 88, which may be a round wire snap ring. Snap ring 88 is designed to snap into an internal channel 91 in shaft 22 during installation, axially securing shaft 20 to shaft 22. Spline couplings 28, 30, snap ring 88 and groove 91, and the female end of shaft 22 essentially make up a coupling member. IN this embodiment, shaft 22 is a hollow shaft, as indicated 23, although the invention is not so limited. As depicted sequentially in FIGS. 15B, 15C, and 15D, as shaft 20 slides into the female opening in the end of shaft 22, snap ring 88 is first compressed by chamfer 90 into groove 77, then with further movement snaps out of groove 77 and into place in channel 91. Further, as groove 91 provides a reduce wall cross section in the female end portion of shaft 22, this feature may serve as a torque-limit measure.

Figure 16:
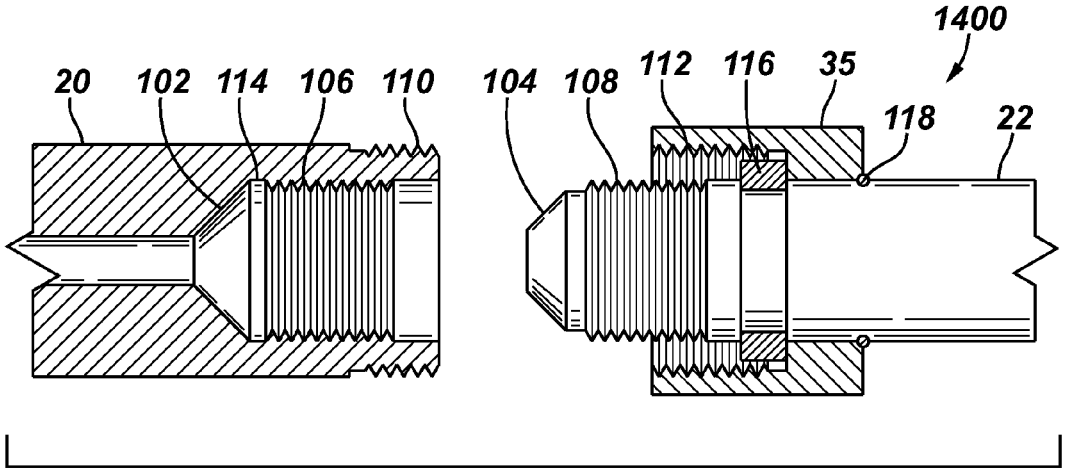
Figure 17:
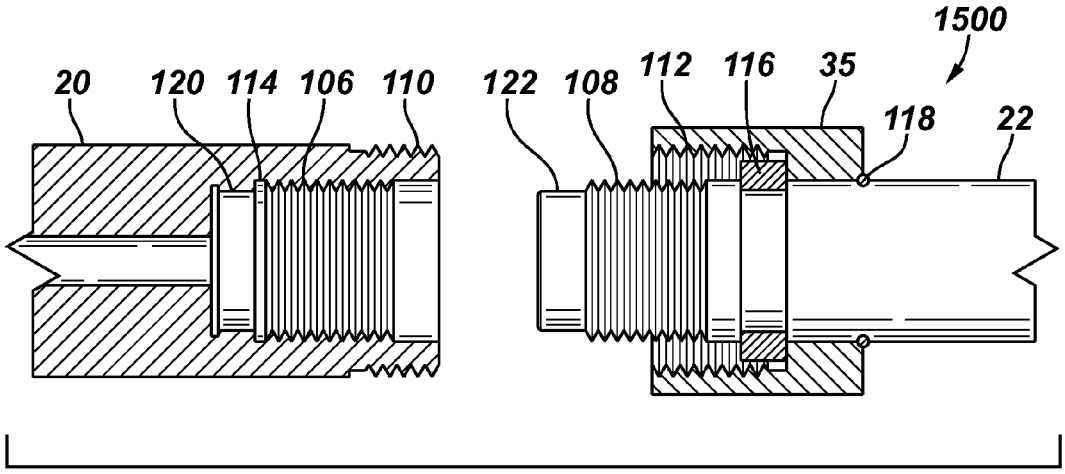

FIGS. 16 and 17 illustrate schematically two similar embodiments 1400 and 1500, respectively. Both embodiments are illustrated as they might appear prior to assembly. In embodiment 1400 of FIG. 16, shaft 20 includes a conical aperture 102 that mates with a solid conical terminal section 104 of shaft 22 when assembled. A threaded female section 106 inside of shaft 20 also mates with a threaded male portion 108 of shaft 22 when assembled. Undercuts 114 aid in threading and boring of threads 106 and conical aperture 102. Another set of threads, 110 on an external portion of shaft 20, mates with a set of internal threads 112 in coupling member 35. Coupling member 35 may be a standard nut in this embodiment, fitted with a two piece ring 116. A round wire snap ring 118 helps to axially secure shaft 22 to coupling member 35. Threads 112 may serve as a torque-limiting feature, as well as materials of construction of coupling member 35. FIG. 17 illustrates a similar embodiment 1500, having a straight aperture 120 in shaft 20 rather than a conical aperture 102 as in embodiment 1400 of FIG. 16. Straight aperture 120 accepts a pilot extension 122 of shaft 22 which bottoms out in aperture 120. Other than these differences, embodiments 1400 and 1500 are identical.

Figure 18A:
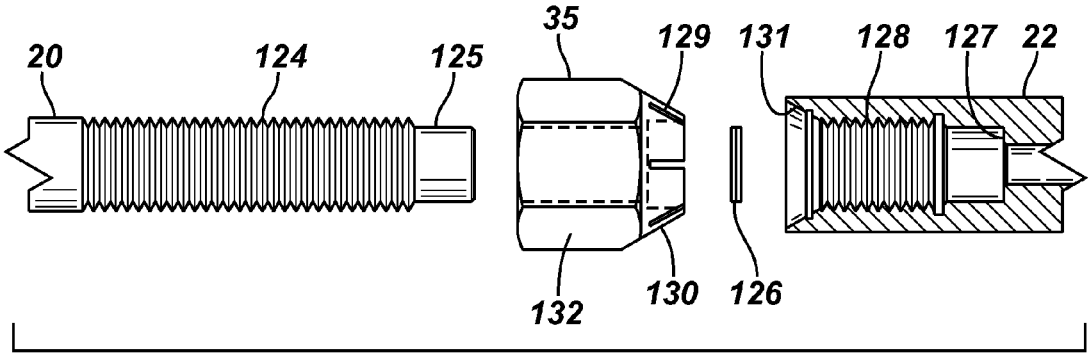
Figure 18B:
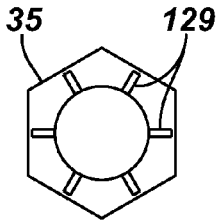
Figure 18C:
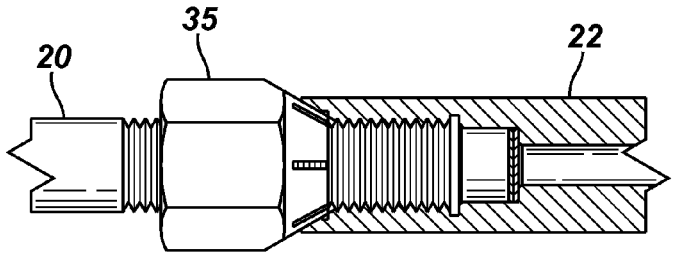
Figure 19:
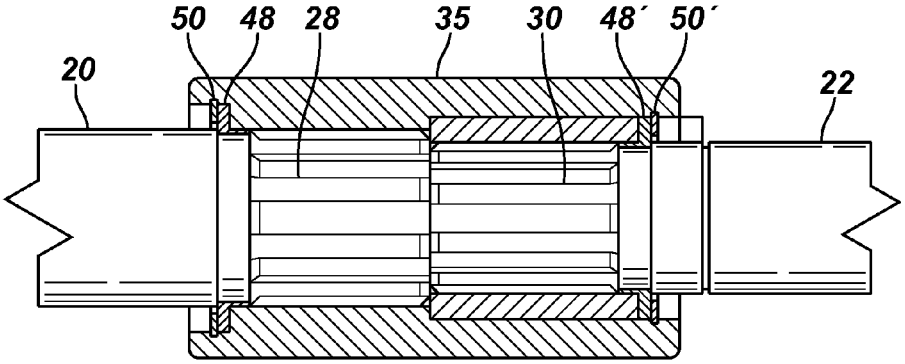
Figure 19A:
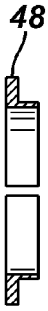
Figure 19B:
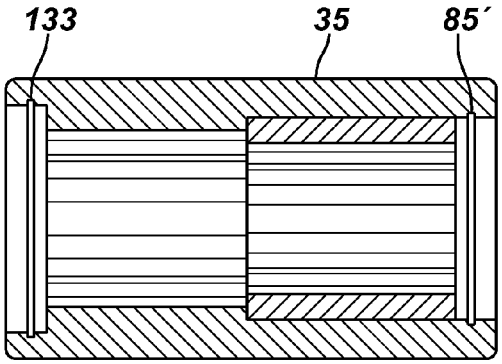
Figure 19C:
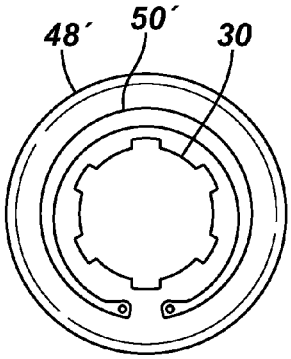
Figure 19D:
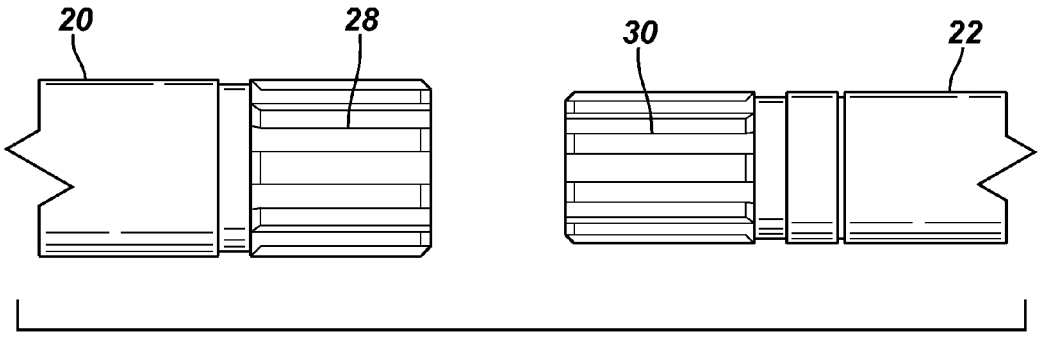

FIGS. 18A-18C illustrate yet another embodiment of the invention. FIG. 18A illustrates an exploded, partial cross-sectional view. In this embodiment, shaft 20 includes a threaded section 124 and a non-threaded terminal section 125. Non-threaded terminal section 125 accepts a bolt-locking washer 126, which in turn seats at the end 127 of a bore in the end of shaft 22. A portion 128 of the bore is threaded to accept threaded section 124 of shaft 20. Coupling member 35 in this embodiment may comprise a barbed nut having barbs 130 and undercuts 129 (FIG. 18B), allowing barbs 130 to deflect inwardly when assembled into chamfer 131 on shaft 22 and down onto threads 124 of shaft 20. Coupling member or nut 35 has internal threads (not illustrated), and surfaces 132 allowing a wrench or other tool to turn and tighten the assembly. FIG. 18C illustrates the assembled apparatus, partially in cross-section. Both torque and axial forces are transferred by the threads, and additional axial force transmission is supplied by the lock washer 126 and the barbs 130 of coupling member 35. Torque-limiting may be accomplished by materials of construction of coupling member 35, or by any other means described herein or their functional equivalent.

FIGS. 19 and 19A-19D illustrate another embodiment of the invention. Spline connections 28 and 30 are used for torque transfer, while internal circular push on rings 48 and 48', as well as internal snap rings 50 and 50' secure shafts 20 and 22 axially to coupling member 35. Snap ring 50 fits into a groove 133 in coupling member 35, while snap ring 50' fits into a groove 85' in coupling member 35.

Apparatus, systems, and methods of the invention may be employed in a variety of applications, such as in horizontal pumping systems ("HPS"), such as illustrated generally in FIG. 1. Any of a number of drivers, such as motors, turbines, generators, and the like, may be employed. However, the HPS may comprise other pumps, such as positive displacement pumps, in conjunction with the centrifugal pump, and other drivers for a given application. As is known, centrifugal pumps will include a set of impellers and diffusers designed move fluid through the pump, perhaps toward a second or more stage having a different set of impellers and diffusers, eventually forcing fluid out through a discharge. A single pump housing may house all pump stages.

As explained in assignee's U.S. Pat. No. 6,425,735, the motor may be fixedly coupled to horizontal skid at a motor mount surface of the horizontal skid. The pump may be coupled to the horizontal skid by a mount assembly, which may include a support (e.g., a fixed support) and clamp assemblies. The pump may be drivingly coupled to the motor through support. Alternatively, the support may be an external conduit assembly configured for attachment to a pump conduit, such as one of two pump conduits extending from the pump. Pumping systems of the invention may displace water, salt water, sewage, chemicals, oil, liquid propane, or other fluids in through one of the pump conduits and out of another pump conduit. In addition, the temperature of the fluids may vary. For example, some applications may involve pumping hot fluids, while others may involve pumping cold fluids. In addition, the temperature may change during the pumping operation, either from the source of the fluid itself, or possibly due to the heat generated by the operation of the pump and/or driver. In addition, temperature may change dramatically due to weather change.

Electrical submersible pumps ("ESP"), such as pumping systems known under the trade designation Axia™, available from Schlumberger Technology Corporation, may be modified in accordance with the teachings of the invention. Pumps of this type may feature a simplified two-component pump-motor configuration, with pump having one or more stages inside a housing, and a combined motor and protector. The pump may be built with integral intakes and discharge heads. Fewer mechanical connections may contribute to faster installation and higher reliability of this embodiment. The combined motor and protector assembly, known under the trade designation ProMotor™, may be prefilled in a controlled environment, and may include integral instrumentation that measures downhole temperatures and pressures.

An alternative electrical submersible pump configuration in which apparatus and systems of the invention may be employed include an ESP deployed on cable, an ESP deployed on coiled tubing with power cable strapped to the outside of the coiled tubing (the tubing acts as the producing medium), and more recently a system known under the trade designation REDACoil™ having a power cable deployed internally in coiled tubing. For example, three "on top" motors may drive three pump stages, all pump stages enclosed in a housing. The pump stages may be identical in number of pump stages and performance characteristics, while some pump stages may have different performance characteristics. A separate protector may be provided, as well as an optional pressure/temperature gauge, sub-surface safety valve (SSSV) and a chemical injection mandrel. The technology of bottom intake ESPs (with motor on the top) has been established over a period of years. It is important to securely install pump stages, motors, and protector within coiled tubing, enabling quicker installation and retrieval times plus cable protection and the opportunity to strip in and out of a live well. This may be accomplished using a deployment cable, which may be a cable known under the trade designation REDACoil™, including a power cable and flat pack with instrument wire and one or more, typically three hydraulic control lines, one each for operating the lower connector release, SSSV, and packer setting/chemical injection.

Apparatus and systems of the invention may include many optional items. One optional feature of apparatus and systems of the invention is one or more sensors located at the protector to detect the presence of hydrocarbons (or other chemicals of interest) in the internal lubricant fluid. The chemical indicator may communicate its signal to the surface over a fiber optic line, wire line, wireless transmission, and the like. When a certain chemical is detected that would present a safety hazard or possibly damage the motor if allowed to reach the motor, the pump may be shut down long before the chemical creates a problem.

Typical uses of apparatus and systems of the invention will be in downhole and surface fluid transfer applications.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. §112, paragraph 6 unless "means for" is explicitly recited together with an associated function. "Means for" clauses are intended to cover the structures described herein as performing the recited function and not only structural equivalents, but also equivalent structures.

What is claimed is:

1. A coupling member adapted to connect a first shaft with a second shaft, the coupling member comprising:

a first axial chamber adapted to accept a first end of the first shaft, and a second axial chamber adapted to accept a first end of the second shaft;

splines for transmitting rotational movement between the shafts, the axial chambers including the splines;

a coupling plate integral to the coupling member and positioned between the axial chambers wherein the coupling plate comprises a through hole adapted to accept a male portion of an axial motion securing member for securing the shafts from substantial axial movement during rotation of the shafts and coupling member; and at least one torque-limiting element responsive to a level of torque to rotatably decouple the first shaft and the second shaft.

2. The apparatus of claim 1 wherein the coupling plate is positioned approximately midway between first and second ends of the coupling member.

3. The apparatus of claim 1 further comprising additional means for transmitting rotational movement selected from pins, bolts, rivets, clamps, rings, threads, grooves, gears, bearings, collets, and combinations thereof.

4. The apparatus of claim 1 wherein the torque-limiting element is selected from appropriate choice of a coupling materials, one or more grooves on the OD or ID of the coupling member having a variable length and depth so as to limit the cross sectional area and thus the strength of the coupling to a predetermined value, wherein the depth of the grooves may be equal to zero depending on the design and/or choice of material, use of one or more radial or longitudinal shear pins, use of a press fit member designed to slip under a given torsional load, spring loaded mechanisms, cam loaded mechanisms, and any combination of these.

5. A system comprising:

a coupling member for rotatably coupling a first shaft with a second shaft, the coupling member defining a first axial chamber accepting a first end of the first shaft, and a second axial chamber accepting a first end of the second shaft, wherein the coupling member comprises splines within each of the axial chambers for transmitting rotational movement between the shafts and a coupling plate integral to the coupling member and positioned between the axial chambers wherein the coupling plate comprises a through hole adapted to accept a male portion of an axial motion securing member for securing the shafts from substantial axial movement during rotation of the shafts and coupling member; and at least one torque-limiting element responsive to a level of torque to rotatably decouple the first shaft and the second shaft.

6. The system of claim 5 wherein the first shaft is a pump shaft and the securing comprises means selected from (a) the first end of the pump shaft is axially secured in the first axial chamber, and the pump shaft comprises a female aperture or receptacle extending inwardly from the pump shaft first end a certain distance and accepting a male portion of a pump shaft axial securing member, the female receptacle and the male portion of the pump shaft axial securing member being threaded in matching relationship, the pump shaft axial securing member comprises a head, forming with the male portion a bolt, the male portion protruding through the through hole in the coupling plate and threadingly engaging the threads in the female receptacle, while the head engages the coupling plate;

(b) a female aperture or receptacle extending inwardly from the pump shaft first end a certain distance and accepting a male portion of a pump shaft axial securing member, wherein the female receptacle comprises one or more grooves, while the male portion of the pump shaft securing member includes one or more radially extending pins or other protuberances sliding into matching respective grooves and engaging a portion of the matching groove to axially secure the pump shaft to the coupling member;

(c) the pump shaft is axially secured to the coupling member by one or more pins inserted through matching transverse passages through walls of the coupling member which define the first chamber and through a corresponding transverse passage in the pump shaft;

(d) the pump shaft is axially secured to the coupling member by the pump shaft being modified on its outer surface proximate the first chamber inner wall to accept a threaded collar which also has threads on its outer surface mating with threads on an inner wall surface of the first chamber;

(e) the pump shaft is axially secured to the coupling member by the pump shaft being threaded on its outer surface proximate the first chamber inner wall to mate with threads on an inner wall surface of the first chamber;

(f) the pump shaft is axially secured to the coupling member by a two-piece ring;

(g) the pump shaft is axially secured to the coupling member by a snap ring; and (h) combinations of (a)-(h).

7. The system of claim 5 wherein the pump shaft axial securing member is adjustable.

8. The system of claim 5 wherein one or more pump shaft shims are positioned between the coupling plate and the first end of the first pump shaft or between the coupling plate and the first end of the second pump shaft.

9. The system of claim 5 wherein the second shaft is a thrust chamber shaft axially secured to the coupling member by means selected from (a) the first end of the pump shaft is axially secured in the first axial chamber, and the pump shaft comprises a female aperture or receptacle extending inwardly from the pump shaft first end a certain distance and accepting a male portion of a pump shaft axial securing member, the female receptacle and the male portion of the pump shaft axial securing member being threaded in matching relationship, the pump shaft axial securing member comprises a head, forming with the male portion a bolt, the male portion protruding through the through hole in the coupling plate and threadingly engaging the threads in the female receptacle, while the head engages the coupling plate;

(b) a female aperture or receptacle extending inwardly from the thrust chamber shaft first end a certain distance and accepting a male portion of a thrust chamber shaft axial securing member, wherein the female receptacle comprises one or more grooves, while the male portion of the thrust chamber shaft securing member includes one or more radially extending pins or other protuberances sliding into matching respective grooves and engaging a portion of the matching groove to axially secure the thrust chamber shaft to the coupling member;

(c) the thrust chamber shaft is axially secured to the coupling member by one or more pins inserted through matching transverse passages through walls of the coupling member which define the first chamber and through a corresponding transverse passage in the thrust chamber shaft;

(d) the thrust chamber shaft is axially secured to the coupling member by the thrust chamber shaft being modified on its outer surface proximate the first chamber inner wall to accept a threaded collar which also has threads on its outer surface mating with threads on an inner wall surface of the first chamber;

(e) the thrust chamber shaft is axially secured to the coupling member by the thrust shaft being threaded on its outer surface proximate the first chamber inner wall to mate with threads on an inner wall surface of the first chamber;

(f) the thrust chamber shaft is axially secured to the coupling member by a two-piece ring;

(g) the thrust chamber shaft is axially secured to the coupling member by a snap ring; and (h) combinations of (a)-(g).

10. The system of claim 5 wherein the coupling plate has two substantially parallel surfaces substantially perpendicular to a longitudinal axis of the pump shaft and the second shaft, and wherein the pump shaft axial securing member interacts with the coupling plate by way of a head that abuts against one of the substantially parallel surfaces of the coupling plate that faces the thrust chamber shaft.

11. The system of claim 5 wherein a side of the coupling plate facing the second shaft has a recessed area that accepts the head of the pump shaft axial securing member so that it abuts the recessed area, allowing the first end of the second shaft to be positioned substantially flush against the coupling plate.

12. The system of claim 5 wherein the torque-limiting element is selected from appropriate choice of a coupling materials, one or more grooves on the OD or ID of the coupling member having a variable length and depth so as to limit the cross sectional area and thus the strength of the coupling to a predetermined value, wherein the depth of the grooves may be equal to zero depending on the design and/or choice of material, use of one or more radial or longitudinal shear pins, use of a press fit member designed to slip under a given torsional load, spring loaded mechanisms, cam loaded mechanisms, and any combination of these.

13. A method comprising:

(a) measuring axial shaft movement of first and second shafts during operation using a standard coupling;

(b) selecting a coupling member adapted to rotatably couple the first and second shafts via splines and to limit the axial shaft movement at least in part via an integral coupling plate disposed between two chambers defined by the coupling member; and (c) installing the coupling member to rotatably couple the first and second shafts via the splines, to limit the axial shaft movement at least in part via the integral coupling plate and to engage at least one torque-limiting element to rotatably decouple the first shaft and the second shaft responsive to a level of torque.

14. The method of claim 13 wherein the selecting a coupling member adapted to limit shaft movement comprises calculating the width and/or number of shaft shims required to limit the axial shaft movement, and installing one or more shaft shims in the coupling member by bolting or other means.

15. The method of claim 14 wherein the installing one or more shaft shims comprises positioning at least one of the one or more shaft shims adjacent to the integral coupling plate.

16. The method of claim 14 wherein the installing the coupling member to limit the axial shaft movement comprises providing a through hole in the integral coupling plate and passing a male portion of an axial securing member through the hole.

17. The method of claim 16 further comprising installing one or more shaft shims on the male portion of the axial securing member.

* * * * *